United States Patent [19]

Martel et al.

[11] Patent Number: 4,895,364

[45] Date of Patent: Jan. 23, 1990

[54] ELECTRONIC GAME APPARATUS

[75] Inventors: Robert J. Martel, Avalon; Thomas G. Bishop, Newport, both of Australia

[73] Assignee: Great Games Pty. Ltd., Australia

[21] Appl. No.: 208,897

[22] Filed: Jun. 17, 1988

[30] Foreign Application Priority Data

Jun. 18, 1987 [AU] Australia ..... PI2543

[51] Int. Cl.[4] ..... A63F 9/00

[52] U.S. Cl. ..... 273/1 GE; 273/1 E; 273/237; 434/352; 446/487

[58] Field of Search ..... 273/1 E, 1 GE, 237, 273/284, 285, 287; 434/352; 446/487

[56] References Cited

U.S. PATENT DOCUMENTS

| | | | |
|---|---|---|---|
| 3,763,577 | 10/1973 | Goodson | 434/352 |
| 3,825,266 | 7/1974 | Bissell | 273/237 |
| 4,007,933 | 2/1977 | Cooper | 273/1 GE |
| 4,207,087 | 6/1980 | Morrison et al. | 273/1 E |
| 4,309,030 | 1/1982 | Goldfarb et al. | 273/1 E |
| 4,444,591 | 4/1984 | Kaga et al. | 273/1 GE |
| 4,770,416 | 9/1988 | Shimizu et al. | 273/1 E |
| 4,772,027 | 9/1988 | Martel et al. | 273/237 |

FOREIGN PATENT DOCUMENTS

| | | | |
|---|---|---|---|
| 2014049 | 8/1979 | United Kingdom | 273/1 GE |

OTHER PUBLICATIONS

"Quiz Master", Gerald Cohn, Electronics Australia, Oct., 1979 vol 41. No. 7, pp. 84–91.

*Primary Examiner*—Edward M. Coven
*Assistant Examiner*—Jessica J. Harrison
*Attorney, Agent, or Firm*—Ostrolenk, Faber, Gerb & Soffen

[57] ABSTRACT

An electronic game apparatus having a central body from which rigid arms extend to remote switches. The arms are pivotally connected to the central body and the remote switches to allow the apparatus to be folded for storage in an upright, free-standing position. Each arm has as member a sequence of numbers by which the players can keep score.

11 Claims, 7 Drawing Sheets

ELECTRONIC GAME APPARATUS

FIELD OF THE INVENTION

This invention relates to an electronic game apparatus.

In prior electronic game apparatus, for example such as that described in Australian Patent specification No. AU 61676/86 by R. J. Martel and T. G. Bishop, the apparatus has been associated with a board on which there is indicia relating to the game to be played and on which the players place their tokens for progression around the board as the game progresses. This necessitates the apparatus to be fitted to the board in a manner to ensure that the board and apparatus function as a single unit. The inclusion of the board and apparatus in the game results in an expensive packaging arrangement that requires a large box to store both the board and the apparatus for both sale of the game and storage during periods of non-use. Therefore, a need has arisen for developing an electronic game apparatus which does not require interaction with a board for the playing of the game and the keeping of game scores.

SUMMARY OF THE INVENTION

The present invention may be defined as providing an electronic game apparatus comprising:

electronic circuitry;

a main body enclosing the electronic circuitry;

a plurality of remote switching devices electrically connected to the electronic circuitry; and a plurality of arms arranged to extend from the main body to respective ones of the remote switching devices and arranged to carry the electrical connections between the electronic circuitry and respective ones of the remote switching devices, wherein the electronic circuitry is operable to sense operation of the remote switching devices and to indicate which device was first operated.

Preferably, the electronic circuitry is further operable to randomly select a switching device to be indicated, on operation of any one of the switching devices, regardless of which switching device is actually operated.

Preferably, the electronic circuitry is further operable to time out pre-determined time periods and to give an indication that the period has expired, the time periods being dependant upon which one of the switching devices is operated.

Preferably, the arms are rigid.

Preferably, the arms are pivotally connected to he main body.

Preferably, the connections between the arms and the main body are snap-in type connections.

Preferably, each remote switching device comprises a switch housing enclosing a switch.

Preferably, the connections between the arms and their associated switch housings are snap-in type connections.

Preferably, the connections are non-releasable connections.

Preferably, each arm is fitted with scoring means.

Preferably, the scoring means is a marker which is slidable along the arm, the arm having a series of numbers displayed thereon and the marker having a cut-out for revealing one number at a time.

Preferably, each arm has a series of detents for holding the marker at desired positions along the arm.

Notwithstanding any other forms that may fall within its scope, one preferred form of the invention will now be described, by way of example only, with reference to the accompanying drawings in which:

DETAILED DESCRIPTION OF THE PREFERRED EMBODIMENT

Figure 1:
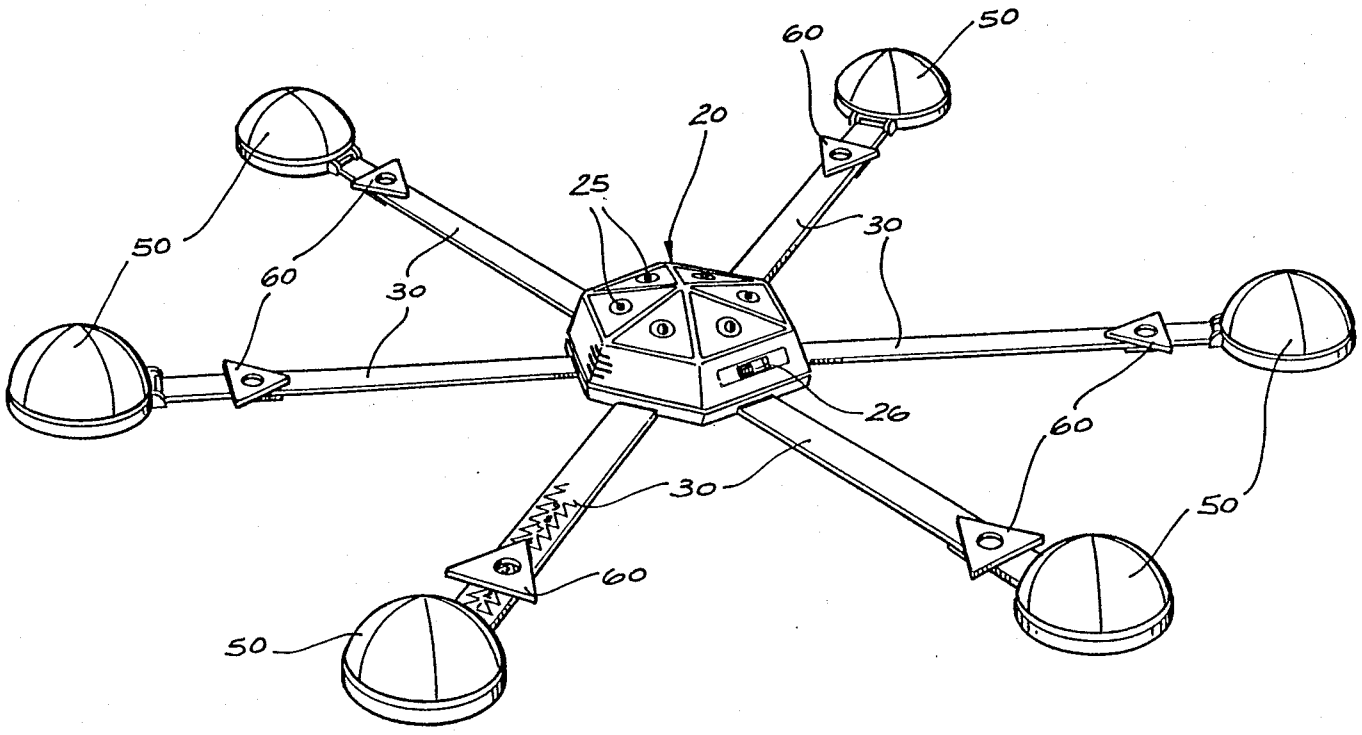
FIG. 1 is a view of an electronic game apparatus according to the present invention when arranged ready for use in a first configuration and having a main body, six arms and six remote switching devices.

As can be seen from FIG. 1 the apparatus of the preferred embodiment comprises a main body 20 in the form of a hexagonal prism with its upper surface slightly pointed. To each of its six sides is attached an arm 30. Attached to the distal end of each arm 30 is a remote switching device in the form of a switch inside a housing 50. The main body 20 houses the electronic circuitry of the apparatus (not shown). The switch housing 50 houses a remote switch 54 operable by depressing the top of the switch housing. Each arm 30 has an electrical cable 45 extending therealong to electrically connect the remote switch to the electronic circuitry of the apparatus.

The main body 20 comprises three main segments, namely a cover 21, a base 22 and a lid 23 for a battery compartment 24 formed in the base 22. The battery compartment 24 is arranged to contain batteries used to power the electronic circuitry. The upper surface of the cover 21 is divided into six sections and each section is provided with a hoe **25*a* to accommodate a light emitting diode (LED) 25 used as part of the indication means of the apparatus. The cover 21 is also provided with a series of holes for the transmission of sound from a speaker connected to the electronic circuitry and located within the main body. An opening allowing access to an on/off switch 26 is provided in the cover 21**.

The switch housing 50 also comprises two main segments, a switch cover 51 and a switch base 52. The switch cover 51 is domed shaped and has a spigot 53 projecting downwardly from the dome apex and is arranged so that depressing the switch cover 51 operates a switch 54 disposed within the switch housing. The switch cover 51 is secured to the switch base 52 by a plurality of prongs 55, with outwardly facing shoulders, extending from the cover and passing through holes in the switch base such that the shoulders bear against the base to prevent withdrawal of the prongs from the holes.

Figure 6:
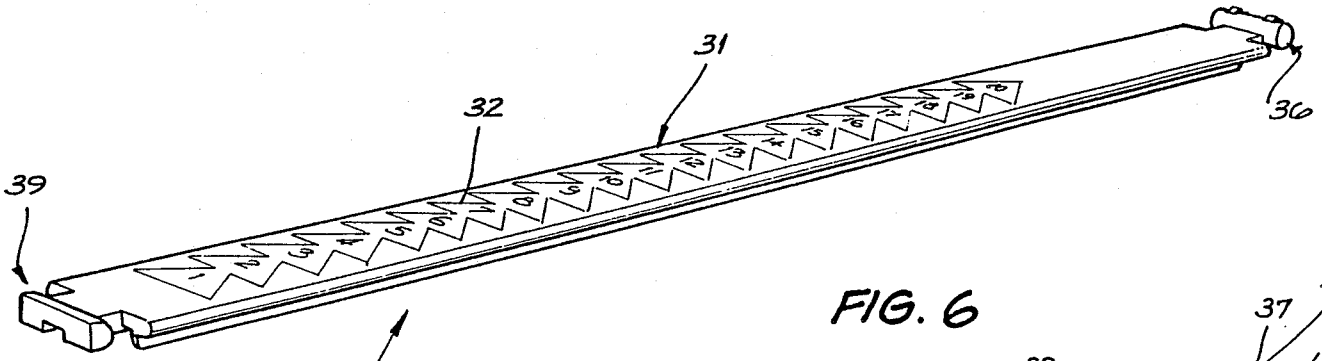
FIGS. 6 and 7 illustrate one arm of the apparatus.
Figure 7:
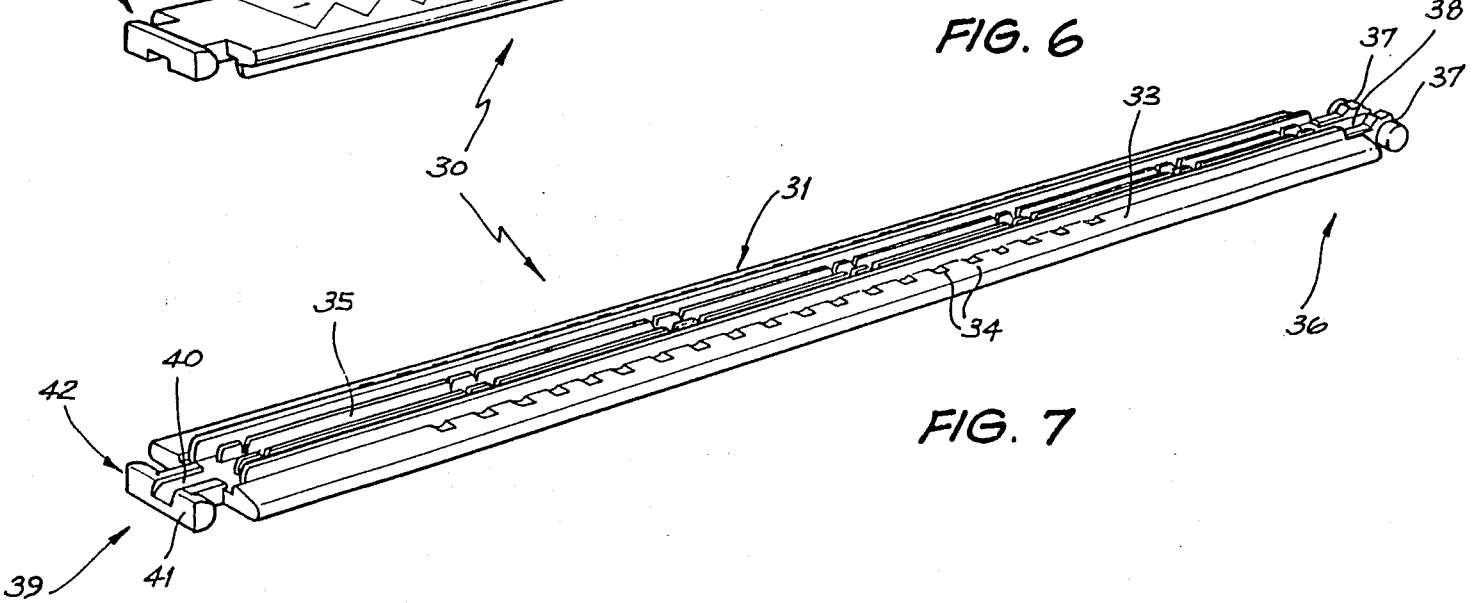

Each arm 30 as shown in FIGS. 6 and 7 comprises a flat elongate body 31. Displayed on the upper surface 32 of the body 31 is a sequential series of numbers used for indicating a player's score with the aid of a marker to be described hereinafter. The lower surface 33 has a series of detents 34 which cooperate with the marker to prevent accidental movement of the marker. A channel 35 is also formed in the lower surface by two raised ridges. This channel is arranged to accommodate and support the electrical cable 45 which extends along the arm 30 and connects the remote switch to the electronic circuitry. The cable 45 is a "FIG. 8" type cable and the channel is sized so that the cable is an interference fit in the channel, thus supporting and protecting the cable.

Figure 8:
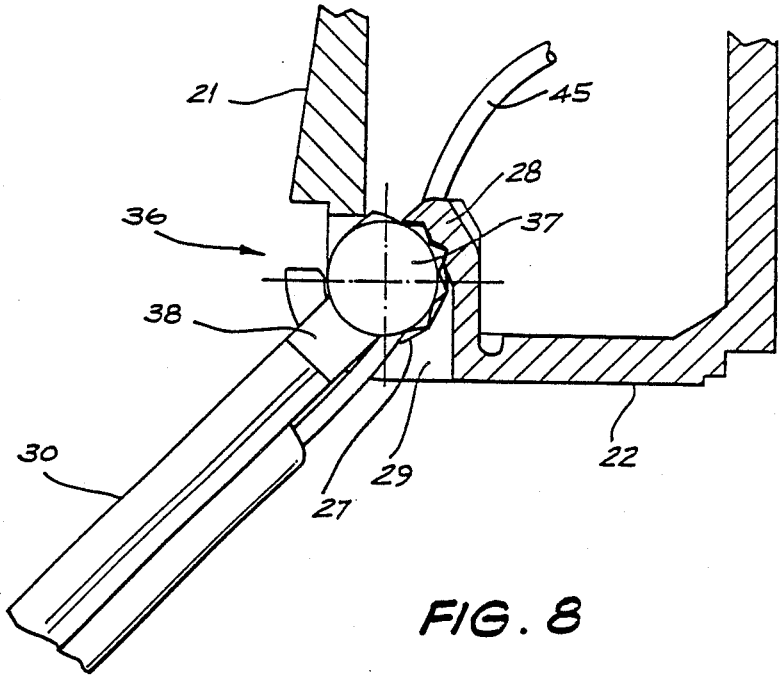
FIG. 8 illustrates the preferred method of connecting the arms to the main body.

The connection of the arm 30 to the main body 20 is illustrated in FIG. 8 in which the cover 21, base 22 and arm 30 are shown in section for clarity. The main body end 36 of the arm 30 has two spigots 37 extending transversely and in opposite directions of an axially extending neck 38. The spigots 37 are arranged to locate in grooves 27 formed in the base 22. The base has a cutout portion 29 through which the neck 38 of the arm may pass so that the arm 30 may pivot with respect to the main body. Two fingers 28 extend from the base and hold the spigots 37 in their respective grooves 27. The fingers 28 are able to be sprung to allow the spigots 37 to be installed. The surface of the fingers 28 which bears against the spigots 37 and the surface of the spigots against which the fingers bear are formed with a series of flat areas co-operating to provide a positive positioning of the arms in the ∓first" and "second" configurations. The cover 21 is arranged to fit over the arm with cutouts as required to accommodate the neck 38 of the arm and prevents the spigots 37 from being withdrawn from the main housing. The cable 45 enters the main body by way of the cutout 29.

Figure 9:
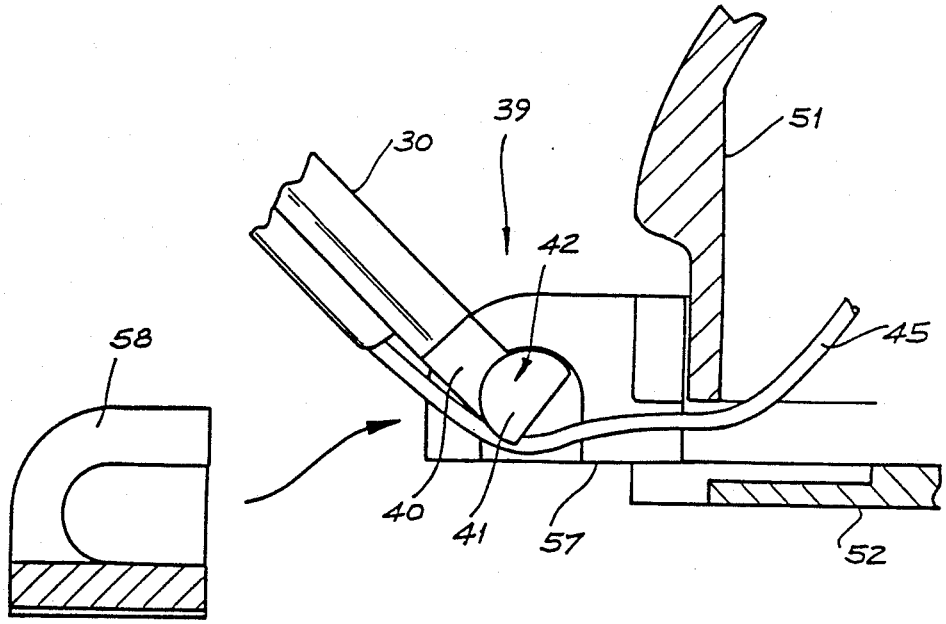
FIG. 9 illustrates a preferred method of connecting the arms to the remote switching devices.

Connection of the arm 30 to the switch housing 50 is similar and is as shown in FIG. 9 in which the switch base 52 is shown in partial section. The switch housing end 39 of the arm has an axially extending neck 40 terminating with two spigots 41 to form a T-shaped projection 42. Projection 42 is arranged to be located in a groove 56 formed in an extension 57 of the base 52 of the switch housing. The groove 56 and the projection 42 cooperate to allow the arm to pivot with respect to the switch housing. The cable 45 enters the switch housing 50 by way of the an entry hole formed in the base extension 57. The projection 42 is held in the groove 56 by a cover 58 which slides over the base extension 57 and closes the groove 56 thus capturing the projection 42.

In a different embodiment, (not illustrated) the switch housing 50 may be rigidly connected to the arm 30. Alternatively, the arm 30 and the switch housing 52 may be moulded as one piece. The remote switch itself may be either a mechanical or electronic type switch e.g. a touch sensitive switch but the preferred embodiment uses a mechanical type switch.

Figure 10:
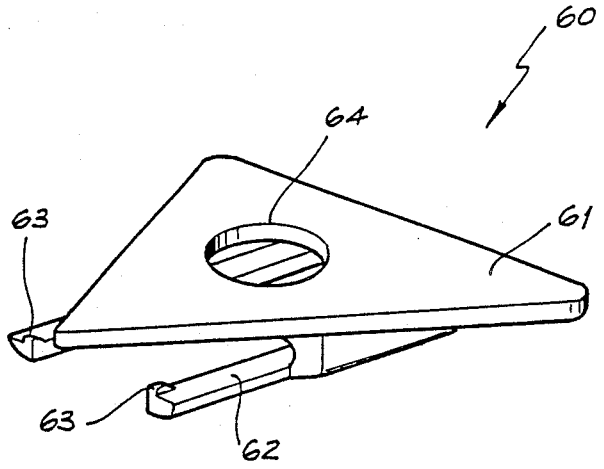
FIG. 10 depicts a perspective view from above of a marker used to indicate a player's score.
Figure 11:
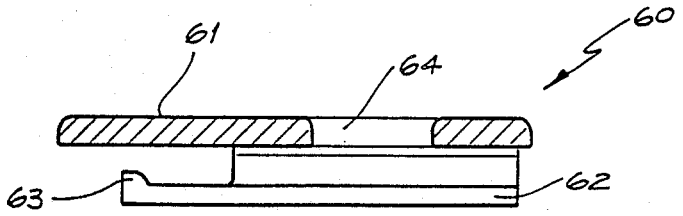
FIG. 11 is a longitudinal sectional view of the marker of FIG. 10.

The marker 60 is depicted in FIGS. 10 and 11. The marker has a main portion 61 in the shape of a triangle or arrowhead. The marker 60 is arranged to slide along the upper surface of the arm 30 and guides 62, formed on the underside of the marker, guide the marker along the arm and to hold the marker to the arm. A small raised portion 63 is cantilevered from each guide and these raised portions 63 cooperate with the detents 34 on the lower surface of the arm to positively locate the marker at desired locations along the arm. The main portion 61 has a hole 64 extending therethrough to enable the numbers displaced on the arm to be visible, one at a time, through the marker. The markings and detents are arranged so that at each desired location one number is visible through the hole 64.

Figure 2:
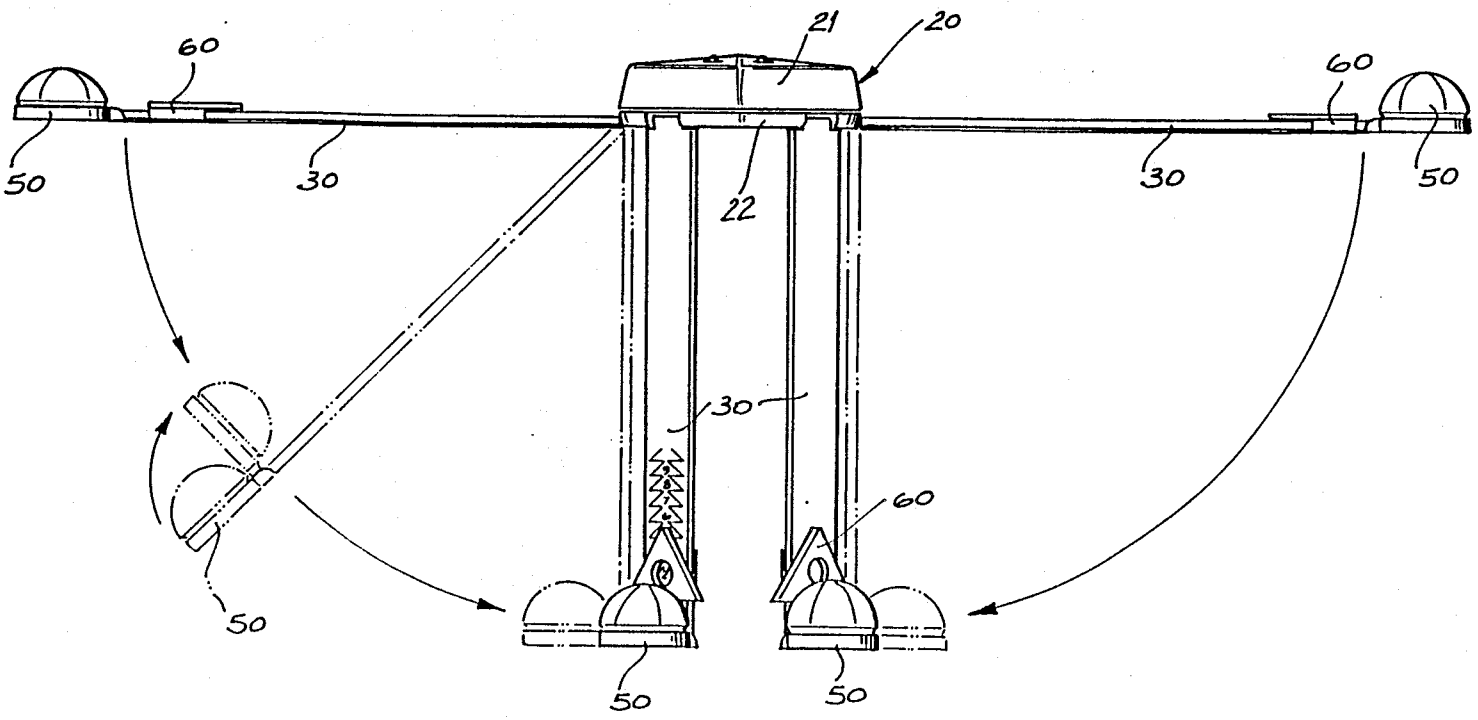
FIG. 2 depicts the apparatus of FIG. 1, illustrating how the apparatus folds into a second configuration for use and/or storage.
Figure 3:
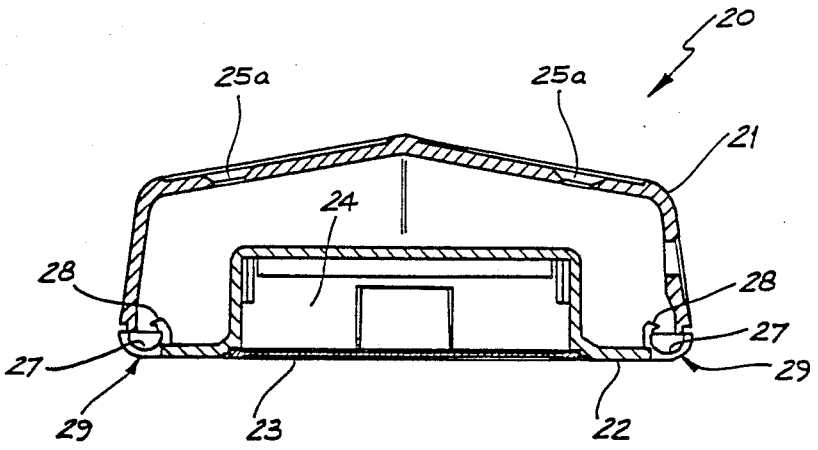
FIG. 3 depicts a sectional view of the main body showing upper and lower portions.
Figure 4:
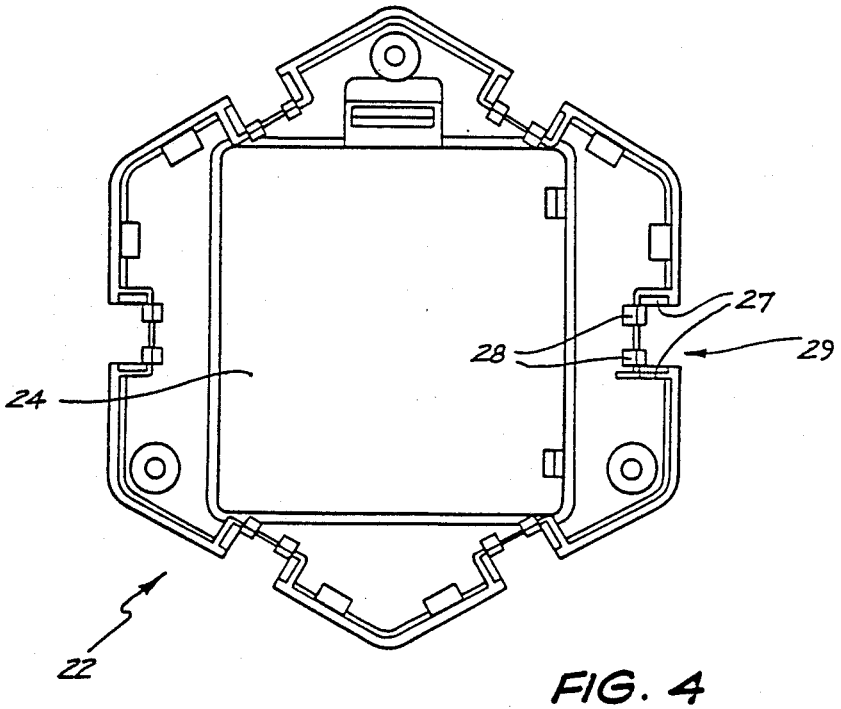
FIG. 4 depicts the lower portion of the main body of the apparatus in FIG. 1 when viewed from above.
Figure 5:
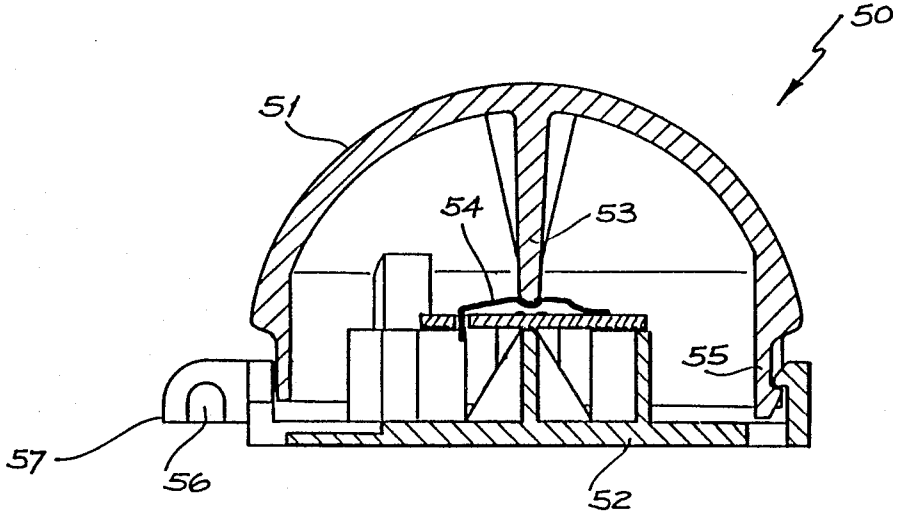
FIG. 5 is a sectional view of a remote switching device.

During use of the apparatus, the apparatus may be spread out in the first configuration as indicated in FIG. 1, in which the main body, arms and secondary bodies all lie on a flat surface e.g. a table top. After use, the apparatus can be folded to the second configuration as shown in FIG. 2 for storage. Alternatively, the apparatus may be played in the second configuration in which case, a smaller playing area is required. The arms are pivoted downwardly from the main body and the remote switches 50 are pivoted upwardly with respect to the arms to reduce the space required for storage while allowing the apparatus to be self-supporting.

A typical use of the apparatus is for quiz-type games such as when one person asks a question and the first person to press their remote switch wins the right to answer. The first operation of any remote switch being indicated by the LED 25 associated with that remote switch. Each correctly answered question advances that player's score by one or more and the score is indicated by moving the marker along the arm, one number at a time until the top score is reached or all the answers for that particular game are exhausted. In the embodiment described up to six players may participate in the game at one time.

The electronic circuitry used in the apparatus may be arranged to be operable in many different ways and in particular in the manner described in Australian patent Specification No. AU-61676/86.

The method of selecting different modes of operation is not important but in the preferred embodiment the selection is determined by which remote switch is depressed when the apparatus is turned on. The switches are colour coded for quick identification.

The premier mode of operation is the "Umpire Mode". This mode and 2 other modes, the "Dice Mode" and the "Time Mode" will now be described as examples of possible modes in which the electronic circuitry may operate.

In the Umpire Mode, the electronic circuitry is activated when any one of the remote switches is operated. The electronic circuitry senses which switch was the first to be operated and initially illuminates all of the LED's either individually or simultaneously. At the same time it initiates an audible output from a miniature speaker within the main body. Thereafter, the electronic circuitry causes one LED to remain illuminated for a short period of time to indicate which of the switches was first to be actuated. Until this short period has expired the electronic circuitry cannot be reactivated.

In the Dice Mode, the electronic circuitry is actuated by operating any one of the switches. The electronic circuitry then selects LED's in a random fashion until one LED is selected and held on for a short period. After this short period has expired the LED is turned off and the electronic circuitry is re-set awaiting the next switch to be operated. The final LED is selected randomly having no apparent relationship with the switch being actuated or the penultimate LED to be illuminated. Each LED may be ascribed a value from 1 to 6.

The Timer Mode actually consists of six different sequences controlled by the individual switches. The Timer Mode counts down a pre-set period. The electronic circuitry is again activated by operation of one of the switches. The time period to be time out is dependent on which switch is operated. For example, the following time periods may be used—brown: 75s, blue: 60s, red: 30s, Purple: 20s, yellow: 12s and green: 8s. During the timing out period, the LED associated with the operated switch will flash to indicate which time period is being timed. During the last moment of the period, say the last five seconds, the LED will flash faster and the speaker will beep to signify the approaching end of the period. At the end of the period, the LED will light up for an extended flash and the speaker will give an extended beep of say one to two seconds to indicate the end of the period. At any time during the timing period the sequence may be stopped by operating the same switch that started the timing sequence.

In all modes if any one of the remote switches is held closed when a sequence finishes, the LED associated with that switch will flash to indicate that the switch is being held in the closed state and the sequence is prevented from being reinitiated.

We claim:

1. An electronic game apparatus comprising:

electronic circuitry;

a main body enclosing the electronic circuitry;

a plurality of remote switching devices electrically connected to the electronic circuitry; and a plurality of rigid arms pivotally connected to and extending from the main body to respective ones of the remote switching devices and arranged to carry the electrical connections between the electronic circuitry and respective ones of the remote switching devices;

wherein the electronic circuitry is operable to sense operation of the remote switching devices and to indicate which device was first operated.

2. Apparatus as defined in claim 1, wherein the electronic circuitry is further operable to randomly select a switching device to be indicated on operation of a switching device regardless of which switching device is actually operated.

3. Apparatus as defined in claim 1, wherein the electronic circuitry is further operable to time out predetermined time periods and to give an indication that the period has expired, the time periods being dependent upon which one of the switching devices is operated.

4. Apparatus as defined in claim 1 wherein the connection between the arms and the main body are snap-in type connections.

5. Apparatus as defined in claim 1 wherein the arms are pivotally connected to respective ones of the switching devices.

6. Apparatus as defined in claim 5 wherein the switching device end of each arm is formed with a T-shaped projection held pivotably captive in a groove formed in a respective switching device by a cover fitted to the switching device.

7. Apparatus as defined in claim 1 wherein each remote switching device comprises a switch housing enclosing a switch.

8. Apparatus as defined in claim 1 wherein each arm is fitted with scoring means.

9. Apparatus as defined in claim 8 wherein said scoring means comprises a marker arranged to be slidable along the arm.

10. Apparatus as defined in claim 9 wherein each arm has a series of detents for holding the marker at predetermined position along the arm.

11. Apparatus as defined in claim 9 wherein the arm has a series of numbers displayed thereon and the marker has a cutout for revealing one number at a time.

* * * * *